US005379026A

United States Patent [19]

Whittle

[11] Patent Number: 5,379,026

[45] Date of Patent: Jan. 3, 1995

[54] TOXIC COMBUSTION GAS ALARM

[76] Inventor: Leonard C. Whittle, RT #1 Box 795C, Spicewood, Tex. 78669

[21] Appl. No.: 77,276

[22] Filed: Jun. 17, 1993

[51] Int. Cl.[6] ..... G08B 17/10

[52] U.S. Cl. ..... 340/632; 116/4

[58] Field of Search ..... 340/628, 632, 633, 634; 73/23.21; 126/116 A; 116/4, 5

[56] References Cited

U.S. PATENT DOCUMENTS

| | | | |
|---|---|---|---|
| 3,955,186 | 5/1976 | Green et al. | 340/634 X |
| 4,349,148 | 9/1982 | Liberto et al. | 236/11 |
| 4,478,048 | 10/1984 | Dills | 62/126 |
| 4,808,977 | 2/1989 | Hedrick | 340/691 |
| 4,862,147 | 8/1989 | Thomas | 340/628 |
| 4,881,063 | 11/1989 | Fawcett | 340/628 X |
| 5,146,209 | 9/1992 | Beghelli | 340/628 X |
| 5,189,392 | 2/1993 | Kass et al. | 340/632 X |
| 5,239,980 | 8/1993 | Hilt et al. | 126/116 A |

*Primary Examiner*—Jeffery A. Hofsass
*Attorney, Agent, or Firm*—Hugh E. Smith

[57] ABSTRACT

A carbon-monoxide detector and alarm circuit for alerting occupants of a structure to a presence of a toxic gas. The apparatus utilizes a probe to detect carbon-monoxide within an air duct of a conventional furnace installation. A siren and a flashing red light are both activated upon a detection of a predetermined amount of carbon-monoxide within the air duct, thereby alerting the occupants to the presence of such carbon-monoxide. The apparatus also includes a warning sign which deploys upon activation of the alarm circuit.

2 Claims, 4 Drawing Sheets

TOXIC COMBUSTION GAS ALARM

BACKGROUND OF THE INVENTION

1. Field of the Invention

The present invention relates to alarms and more particularly pertains to toxic combustion gas alarms which may be utilized for alerting occupants of a structure to a presence of a toxic gas.

2. Description of the Prior Art

The use of alarms is known in the prior art. More specifically, alarms heretofore devised and utilized for the purpose of detecting toxic gases are known to consist basically of familiar, expected and obvious structural configurations, notwithstanding the myriad of designs encompassed by the crowded prior art which have been developed for the fulfillment of countless objectives and requirements.

For example, a flame and carbon-monoxide sensor and alarm circuit is disclosed in U.S. Pat. No. 3,909,816 which utilizes a gas burner monitor providing dual sensing features wherein both flame color and combustion products are monitored by means of an electronic circuit.

A carbon-monoxide alarm for automobiles is illustrated in U.S. Pat. No. 3,786,462 which may be utilized for alerting an operator of a motor vehicle to a presence of a predetermined level of carbon-monoxide gas within a portion of the vehicle.

Another patent of interest is U.S. Pat. No. 4,846,410 which describes an apparatus for monitoring low level combustibles. The control system utilizes measurements of the net oxygen level and the carbon-monoxide equivalent level of the combustible gases within a pulverizing mill both to actuate alarms and to accomplish an inerting of the mill.

While these devices fulfill their respective, particular objectives and requirements, the aforementioned patents do not describe a toxic combustion gas alarm for alerting occupants of a structure to a presence of a toxic gas which utilizes a probe to detect carbon-monoxide within an air duct of a conventional furnace installation.

In this respect, the toxic combustion gas alarm according to the present invention substantially departs from the conventional concepts and designs of the prior art, and in so doing provides an apparatus primarily developed for the purpose of alerting occupants of a structure to a presence of a toxic gas.

SUMMARY OF THE INVENTION

In view of the foregoing disadvantages inherent in the known types of alarms now present in the prior art, the present invention provides a new toxic combustion gas alarm construction wherein the same can be utilized for alerting occupants of a structure to a presence of a toxic gas. As such, the general purpose of the present invention, which will be described subsequently in greater detail, is to provide a new toxic combustion gas alarm apparatus which has many of the advantages of the alarms mentioned heretofore and many novel features that result in a toxic combustion gas alarm which is not anticipated, rendered obvious, suggested, or even implied by any of the prior art alarms, either alone or in any combination thereof.

To attain this, the present invention essentially comprises a carbon-monoxide detector and alarm circuit for alerting occupants of a structure to a presence of a toxic gas. The apparatus utilizes a probe to detect carbon-monoxide within an air duct of a conventional furnace installation. A siren and a flashing red light are both activated upon a detection of a predetermined amount of carbon-monoxide within the air duct, thereby alerting the occupants to the presence of such carbon-monoxide. The apparatus also includes a warning sign that contains written instructions as to the nature of the alarm which deploys upon activation of the alarm circuit.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toxic combustion gas alarm apparatus which has many of the advantages of the alarms mentioned heretofore and many novel features that result in a toxic combustion gas alarm which is not anticipated, rendered obvious, suggested, or even implied by any of the prior art alarms, either alone or in any combination thereof.

It is another object of the present invention to provide a new toxic combustion gas alarm which may be easily and efficiently manufactured and marketed.

It is a further object of the present invention to provide a new toxic combustion gas alarm which is of a durable and reliable construction.

An even further object of the present invention is to provide a new toxic combustion gas alarm which is susceptible of a low cost of manufacture with regard to both materials and labor, and which accordingly is then susceptible of low prices of sale to the consuming public, thereby making such toxic combustion gas alarms economically available to the buying public.

Still yet another object of the present invention is to provide a new toxic combustion gas alarm which provides in the apparatuses and methods of the prior art some of the advantages thereof, while simultaneously overcoming some of the disadvantages normally associated therewith.

Still another object of the present invention is to provide a new toxic combustion gas alarm for alerting occupants of a structure to a presence of a toxic gas.

Yet another object of the present invention is to provide a new toxic combustion gas alarm which utilizes a probe to detect carbon-monoxide within an air duct of a conventional furnace installation.

Even still another object of the present invention is to provide a new toxic combustion gas alarm in which both a siren and a flashing red light are activated upon a detection of a predetermined amount of carbon-monoxide within an air duct.

Even still yet another object of the present invention is to provide a new toxic combustion gas alarm which includes a warning sign that automatically deploys upon an activation of the alarm.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENTS

Figure 1:
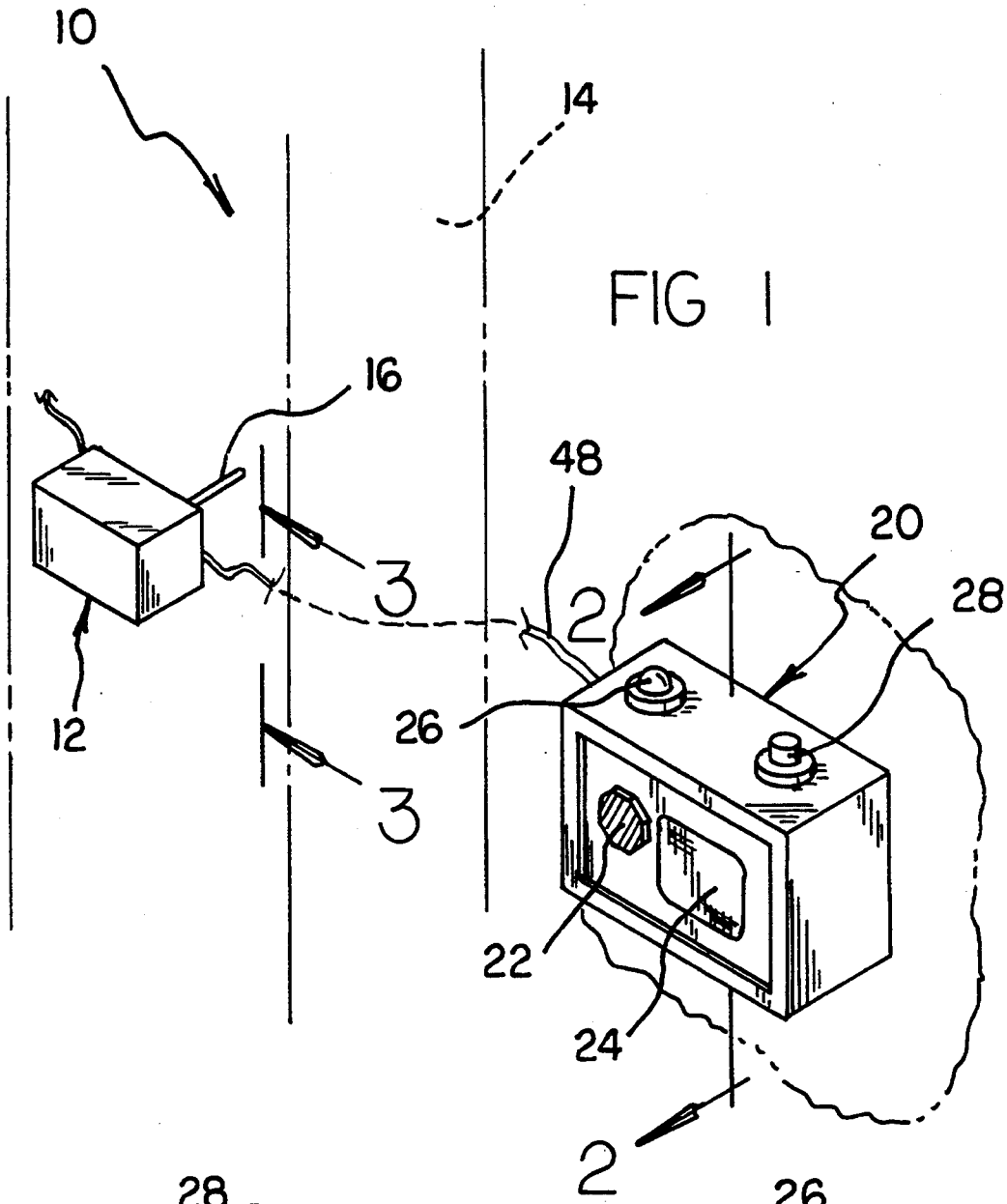
FIG. 1 is a perspective view of a toxic combustion gas alarm comprising the present invention.

With reference now to the drawings, and in particular to FIGS. 1-5 thereof, a new toxic combustion gas alarm embodying the principles and concepts of the present invention and generally designated by the reference numeral 10 will be described.

The toxic combustion gas alarm 10 utilizes a combustion gas sensor 12 that may be readily installed to an exterior surface of a conventional duct 14 which allows a sensor probe 16 to project into the duct through an unillustrated aperture therein. The sensor probe 16 is operable to detect a presence of carbon-monoxide or other toxic gases present within the duct 14. The combustion gas sensor 12 is electrically connected to an alarm unit 20. The alarm unit 20 may be conveniently located within an interior of the structure upon a wall or the like. The alarm unit 20 includes a warning light 22 and a siren 24 which are both actuated upon a detection of carbon-monoxide or other toxic gases by the sensor probe 16 within the duct 14. The alarm unit 20 further includes an indicating light 26 to display a supply of electrical power to the alarm 10, and a test switch 28 which may be utilized to selectively energize both the warning light 22 and the siren 24 for testing purposes.

Figure 3:
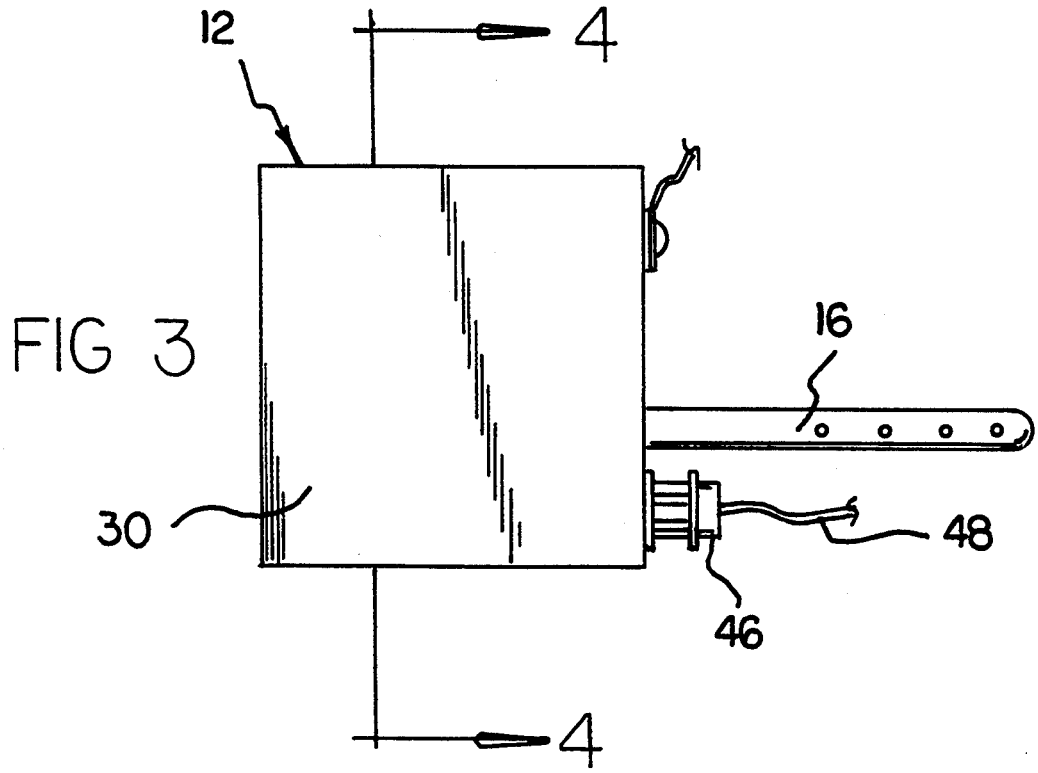
FIG. 3 is a side elevation view of a portion of the invention as viewed from line 3—3 of FIG. 1.
Figure 4:
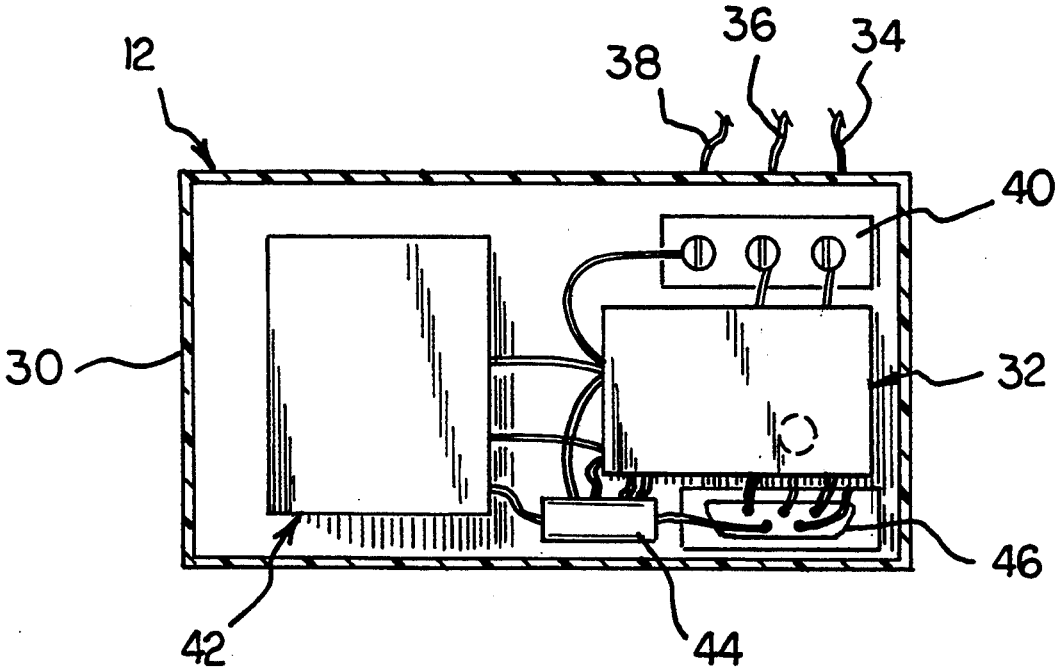
FIG. 4 is a cross sectional view taken along line 4—4 of FIG. 3.

More specifically, it will be noted that the toxic combustion gas alarm 10 comprises a sensor case 30 which may be readily mounted to an exterior surface of a conventional duct 14 within a structure. The sensor case 30 supports the sensor probe 16 which projects through an unillustrated aperture in the duct 14 and is operable to detect a presence of carbon-monoxide or other toxic gases therewithin. The sensor probe 16 is of a conventional design and is electrically connected to conventional sensor electronics 32 which are contained within the sensor case 30. A ground wire 34, a thermostat power wire 36, and a gas valve wire 38 are typically part of a conventional furnace installation and may be connected to a terminal block 40 which is located on an exterior surface of the sensor case 30 that facilitates electrical communication between the wires 34–38 and the conventional sensor electronics 32, an alarm controller 42, and a relay 44 contained therewithin, as best shown in FIGS. 3–4. Furthermore, a connector 46 is disposed upon an exterior surface of the sensor case 30 and is operable to releasably couple an electrical cable 48 thereto which provides electrical communication between the combustion gas sensor 12 and the alarm unit 20.

Figure 2:
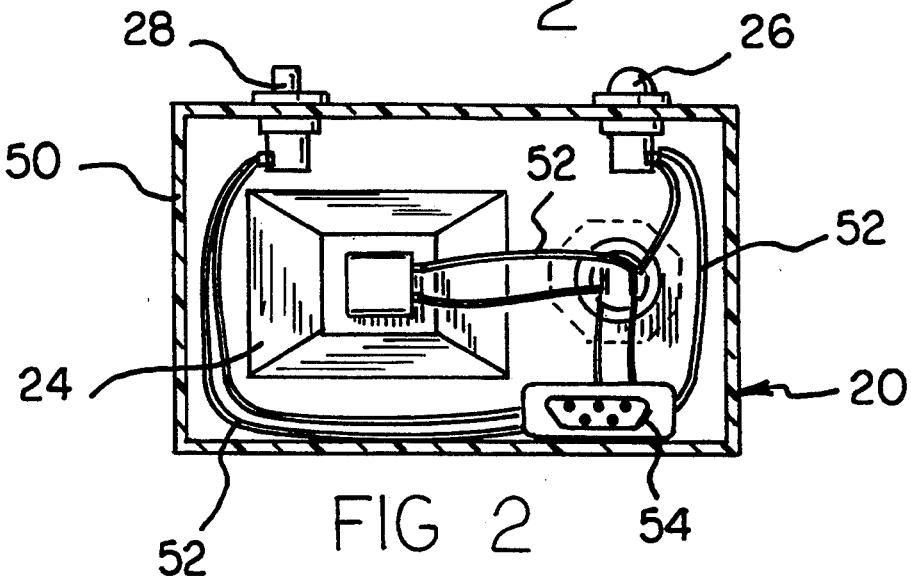
FIG. 2 is a cross-sectional view taken along line 2—2 of FIG. 1.

The alarm unit 20 includes an alarm case 50 which may be mounted to an interior surface of the structure by any conventional means such as adhesive, fasteners, and the like. The warning light 22, the siren 24, the indicating light 26, and the test switch 28 are all fixedly secured to an interior of the alarm case 50 and project through unlabeled apertures in the alarm case so as to facilitate an operation thereof by a user in a well understood manner. As best illustrated in FIG. 2, a plurality of wires 52 provide electrical communication between the components contained within the alarm case 50 and an electrical connector 54 which may be engaged to an unillustrated connector of the cable 48, thereby completing electrical communication between the alarm unit 20 and the combustion gas sensor 12.

Figure 5:
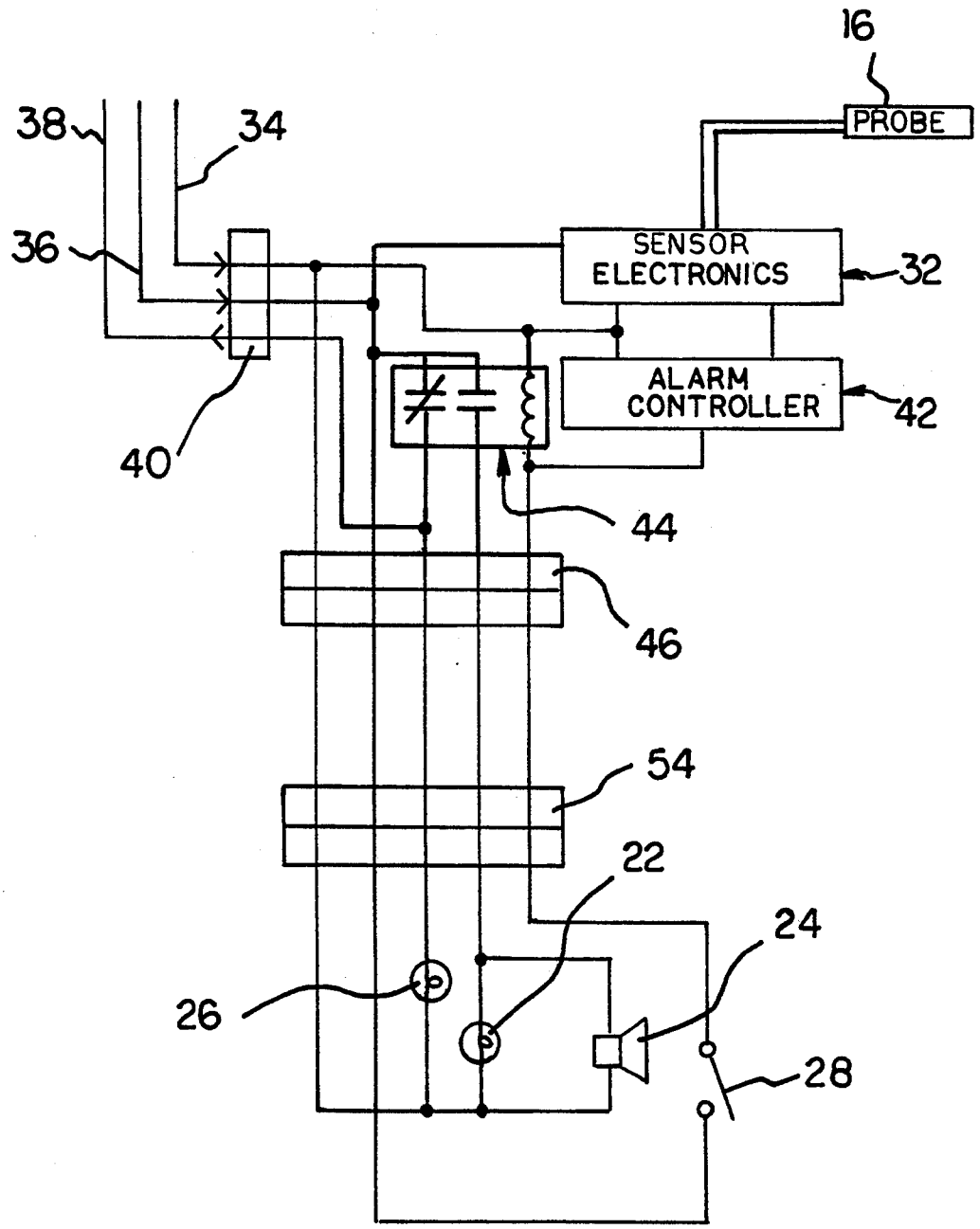
FIG. 5 is a diagrammatic electrical circuitry of the invention.

FIG. 5 diagrams the electrical communication between components of the toxic combustion gas alarm 10. The ground wire 34 is connected to a common or neutral side of the low voltage transformer which is part of a typical furnace installation. The thermostat power wire 36 is connected to a conventional thermostat such that the toxic combustion gas alarm 10 is energized whenever the furnace is operating. The gas valve wire 38 is connected to a conventional electrically operated gas valve present in the conventional furnace installation which provides a termination of a flow of gas to the furnace upon an actuation of the alarm 10. The alarm unit 20 is electrically connected to the combustion gas sensor 12 by the cable 48 such that all power utilized by the alarm unit is conducted through the cable. The alarm unit 20 includes the indicating light 26 which is illuminated whenever the thermostat allows the furnace to operate so as to display an energization of the alarm 10.

The sensor probe 16 is disposed within the duct 14 and is operable to sense a presence of carbon monoxide or other toxic gases within the duct which may be produced by a defective or otherwise improperly operating furnace. The sensor probe 16 is electrically connected to the sensor electronics 32 in a manner such that, upon a detection of a toxic gas by the sensor probe, the sensor electronics will direct the alarm controller 42 to actuate the relay 44. The relay 44 is electrically connected to the alarm unit 20 such that, upon its actuation, the indicating light 26 will be de-energized and both the warning light 22 and the siren 24 will be energized, thus alerting occupants of the structure to a presence of a toxic gas within the duct 14.

The test switch 28 is electrically connected to both the relay 44 and the thermostat power wire 36 such that an operation of the relay may be checked by a user. The test switch 28 is operable to actuate the relay 44, thereby causing an energization of both the warning light 22 and the siren 24, thus confirming their proper operation.

Figure 6:
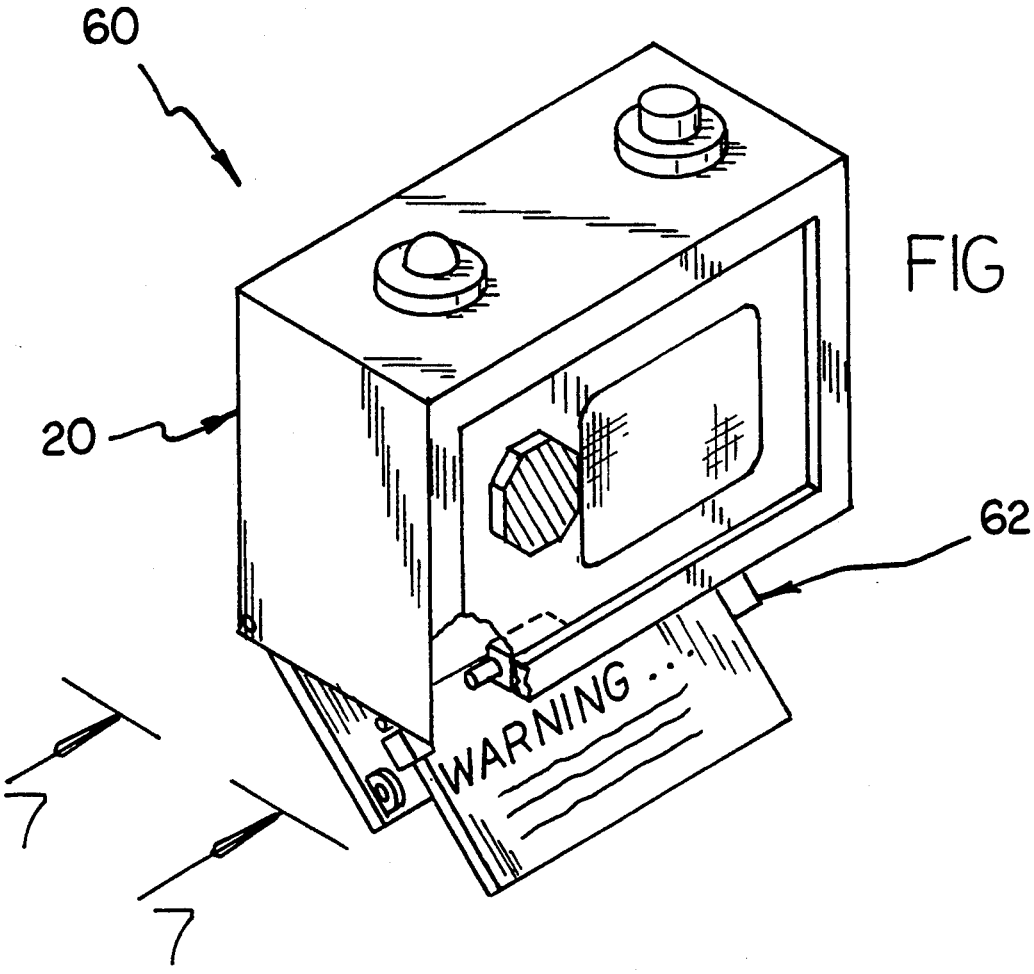
FIG. 6 is a perspective view of second embodiment of the present invention.
Figure 7:
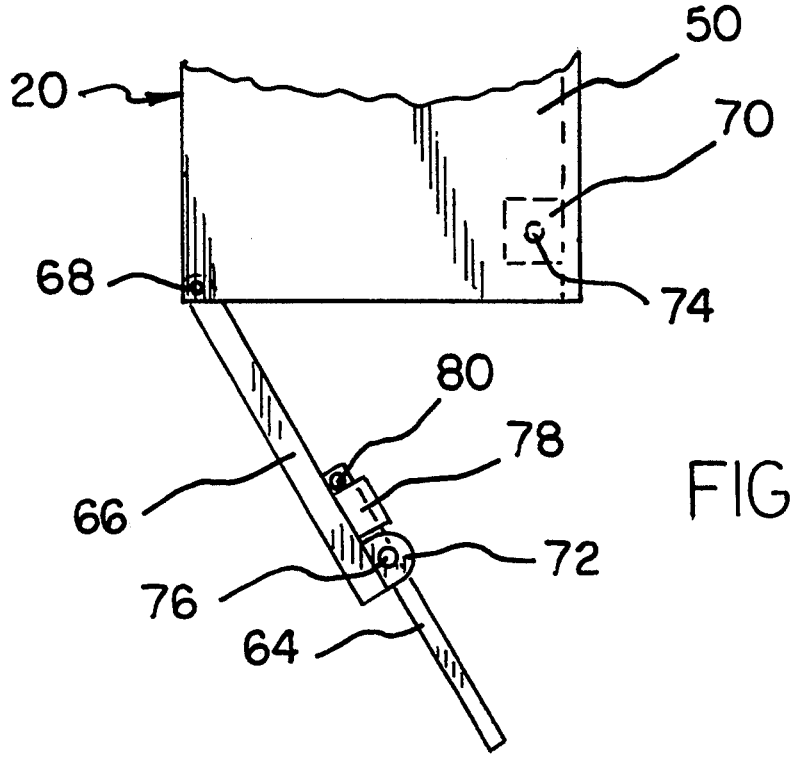
FIG. 7 is an enlarged side elevation view of a portion of the second embodiment as viewed from line 7—7 of FIG. 6.

A second embodiment of the present invention as generally designated by the reference numeral 60, which comprises substantially all of the features of the foregoing embodiment 10 and which further comprises a warning sign assembly 62 will now be described. As best shown in FIGS. 6–7, it can be shown that the warning sign assembly 62 is operable to extend a warning sign 64 upon an actuation of the alarm unit 20. The warning sign 64 includes a written message to a user which substantially informs the user of the nature of the alarm signal and may also contain precautionary instructions. The warning sign 64 is stowed within the alarm case 50 and is slidably attached to a bottom side 66 of the case. The bottom side 66 is pivotally connected to the alarm case 50 by a hinge 68 and is secured in a closed position by a solenoid latch 70 which engages a catch 72 that is integrally or otherwise secured to the bottom side 66. Upon an actuation of the alarm unit 20, the solenoid latch 70 will remove a plunger 74 from an aperture 76 in the catch 72, thereby allowing the bottom side 66 to pivot away therefrom under a force of gravity. The warning sign 64 is secured to the bottom side 66 by a guide 78 which allows the warning sign to slide relative thereto upon a deployment of the bottom side. A stop 80 is integrally or otherwise secured to the warning sign 64 so as to preclude a sliding separation of the warning sign 64 from the bottom side 66. The warning sign 64 may contain written instructions or other information relating to the nature and danger of the situation detected by the toxic combustion gas alarm 60.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new toxic combustion gas alarm for use with a furnace having an air duct and an electric gas valve, said alarm comprising:

a toxic gas detection means for detecting a predetermined level of carbon monoxide gas within said air duct;

an alarm circuit electrically coupled to said toxic gas detection means for closing said electric gas valve upon detection of said predetermined level of carbon monoxide by said toxic gas detection means;

a siren means electrically coupled to said alarm circuit for generating audible noise upon said detection of said predetermined level of carbon monoxide by said toxic gas detection means;

a light means electrically coupled to said alarm circuit for generating visual light upon said detection of said predetermined level of carbon monoxide by said toxic gas detection means;

a test circuit means in electrical communication with said alarm circuit for selectively actuating said alarm circuit to simulate said detection of said predetermined level of carbon monoxide by said toxic gas detection means to verify proper operation of said alarm circuit;

a case mountable to a wall for containing said alarm circuit, said siren means, said light means, and said test circuit, said case comprising a hinge and a bottom side having a catch, with the hinge pivotally connecting the bottom side to the case, said bottom side having an interior surface and a pair of spaced, parallelly aligned guides mounted to said interior surface of said bottom side; a solenoid latch mounted to said case and electrically coupled to said alarm circuit, with the solenoid latch being engagable to said catch to retain said bottom side in a first horizontal position; a warning sign slidably captured between said guides and releasably contained within said case, said warning sign having a stop limiting slidable movement of said warning sign relative to said bottom side, with said warning sign further having written instructions explaining the nature and danger of said detection of said predetermined level of carbon monoxide by said toxic gas detection means, whereby upon said detection of said predetermined level of carbon monoxide by said toxic gas detection means the solenoid latch releases said catch to allow said bottom side to pivot away from the case under a force of gravity into a second non-horizontal position, whereby said warning sign will slidably extend downward into view.

2. The toxic combustion gas alarm of claim 1, and further comprising an indicating light in electrical communication with said alarm circuit for indicating an energization of said alarm circuit.

* * * * *